US005519379A

United States Patent [19]

Ho et al.

[11] Patent Number: 5,519,379

[45] Date of Patent: May 21, 1996

[54] MULTI-THREAD RE-ENTRANT MARKER WITH SIMULTANEOUS SWITCHING

[75] Inventors: Wing Ho, Boynton Beach, Fla.; Jiro Yamasaki, Fukuoka, Japan

[73] Assignee: Sensormatic Electronics Corporation, Deerfield Beach, Fla.

[21] Appl. No.: 419,380

[22] Filed: Apr. 19, 1995

[51] Int. Cl.[6] ..... G08B 13/24

[52] U.S. Cl. ..... 340/551; 340/572

[58] Field of Search ..... 340/551, 572

[56] References Cited

U.S. PATENT DOCUMENTS

| | | | |
|---|---|---|---|
| 4,660,025 | 4/1987 | Humphrey | 340/572 |
| 4,710,754 | 12/1987 | Montean | 340/572 |
| 4,960,651 | 10/1990 | Pettigrew et al. | 428/607 |

*Primary Examiner*—Glen Swann

*Attorney, Agent, or Firm*—Robin, Blecker, Daley & Driscoll

[57] ABSTRACT

A marker for a harmonic electronic article surveillance system includes three wires of magnetic material arranged in parallel. The material has a magnetic hysteresis loop with a large Barkhausen discontinuity such that, upon exposure of the marker to an external magnetic field whose field strength in the direction opposing the instantaneous magnetic polarization of the marker exceeds a predetermined threshold value, there results a regenerative reversal of the magnetic polarization in the material. The three wires are coupled at opposite ends thereof by magnetic charge spreading elements formed of a highly permeable material so that all three wires exhibit the regenerative reversal simultaneously on exposure to the above-described magnetic field. The resulting harmonic marker can be formed with a substantially shorter over-all length than previously practical markers of the harmonic type while providing a signal of comparable amplitude.

34 Claims, 2 Drawing Sheets

MULTI-THREAD RE-ENTRANT MARKER WITH SIMULTANEOUS SWITCHING

FIELD OF THE INVENTION

This invention relates to article surveillance and more particularly to article surveillance systems generally referred to as of the harmonic type.

BACKGROUND OF THE INVENTION

It is well known to provide electronic article surveillance (EAS) systems to prevent or deter theft of merchandise from retail establishments. In a typical system, markers designed to interact with a magnetic field placed at the store exit are secured to articles of merchandise. If a marker is brought into the field or "surveillance zone," the presence of the marker is detected and an alarm is generated.

One type of magnetic EAS system is referred to as a harmonic system because it is based on the principle that a magnetic material passing through an electromagnetic field having a selected frequency disturbs the field and produces harmonic perturbations of the selected frequency. The detection system is tuned to recognize certain harmonic frequencies and, if present, causes an alarm.

A basic problem in the design of markers for harmonic EAS systems is the need to have the marker generate a harmonic signal that is both of sufficient amplitude to be readily detectable and also is sufficiently unique so that the detection equipment can be tuned to detect only the signal generated by the marker, while disregarding harmonic disturbances caused by the presence of items such as coins, keys, and so forth. A known approach to this problem is to develop markers that produce high order harmonics with sufficient amplitude to be readily detectable. A particularly useful technique along these lines is disclosed in U.S. Pat. No. 4,660,025, issued to Humphrey, the disclosure of which is incorporated herein by reference. The Humphrey patent discloses a harmonic EAS marker employing as its active element a wire of magnetic material which has a magnetic hysteresis loop with a large discontinuity, known as a "Barkhausen discontinuity."

A marker of the type disclosed in the Humphrey patent is shown in FIG. 1. The marker, designated generally by the reference number 10, consists of an active element 11, in the form of a wire of magnetic material, sandwiched between a substrate 12 and a overlayer 13. Typically, an adhesive is provided on the lower surface of the substrate 12 for use in affixing the marker 10 to an article of merchandise (not shown).

The wire 11 is of the type referred to as "re-entrant;" that is, it exhibits a magnetic hysteresis loop, as shown in FIG. 2, characterized by Barkhausen discontinuities, represented by broken lines 14. As a result, upon exposure to an alternating magnetic field of sufficient amplitude, the wire 11 undergoes substantially instantaneous regenerative reversals in magnetic polarity, producing very sharp signal spikes that are rich in detectable high harmonics of the frequency of the alternating field.

Markers employing the type of active element just described have been very successfully placed in practice, and are in widespread use with harmonic EAS systems distributed by the assignee of the present application under the trademark "AISLEKEEPER".

One design objective that has so far only been partially realized is reduction in length of markers employing re-entrant wires. Re-entrant wire markers currently in use have lengths of about 65 or 90 mm. It would be desirable to provide a harmonic EAS marker substantially shorter than 65 mm for use with relatively small articles of merchandise and/or for incorporation in price marking labels. One constraint upon reducing the length of the re-entrant wires is that large Barkhausen discontinuities can only be produced in active elements having a high ratio of length to cross-sectional area to provide a very low demagnetizing factor. Die-drawn re-entrant wires having a length of 65 mm have been used successfully, but shorter, thinner wires, and re-entrant materials formed as thin films, are very low in mass, and, therefore, generate signals that are too low in amplitude for reliable detection.

It can be contemplated to form a marker using two or more short, thin wires arranged in parallel in order to obtain a higher output amplitude. However, it has been found that the wires do not simultaneously switch polarities in response to the alternating field, and thus fail to provide a signal of the desired amplitude.

OBJECTS AND SUMMARY OF THE INVENTION

It is accordingly a primary object of the invention to provide a harmonic EAS marker that is shorter than markers that are currently in use. It is a further object to provide such a marker incorporating short, thin re-entrant elements.

According to the invention, there is provided a marker for use in an article surveillance system in which an alternating magnetic field is established in a surveillance region and an alarm is activated when a predetermined perturbation to the field is detected, with the marker including a plurality of bodies of magnetic material each having a magnetic hysteresis loop with a large Barkhausen discontinuity such that exposure of the body to an external magnetic field, whose field strength in the direction opposing the magnetic polarization of the body exceeds a predetermined threshold value, results in regenerative reversal of the magnetic polarization; means for magnetically coupling the plurality of bodies so that the bodies exhibit substantially simultaneous regenerative reversal of their respective magnetic polarizations upon exposure of the marker to the external magnetic field having a field strength exceeding the predetermined threshold in a direction opposing the magnetic polarization of the bodies; and means for securing the bodies and the coupling means to an article to be maintained under surveillance.

According to further aspects of the invention, the plurality of magnetic bodies consist of three wires arranged substantially in parallel and the coupling means includes first and second highly permeable metallic coupling members which respectively couple the three wires at first and second ends of the wires.

According to still another aspect of the invention, the coupling members have a direction of magnetic anisotropy that is oriented in the same direction as the wires.

A marker provided in accordance with the invention and having a length of about 25 mm is capable of generating a signal having sufficient amplitude for detection under practical circumstances by conventional harmonic EAS equipment.

BRIEF DESCRIPTION OF THE DRAWINGS

The same reference numerals are used throughout the drawings to designate the same or similar parts.

DESCRIPTION OF THE PREFERRED EMBODIMENTS

Figure 1:
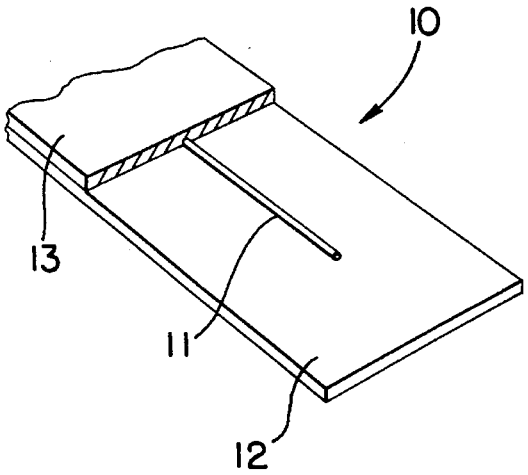
FIG. 1 (PRIOR ART)
FIG. 1 is a perspective view with portions broken away of a prior art harmonic EAS marker.
Figure 2:
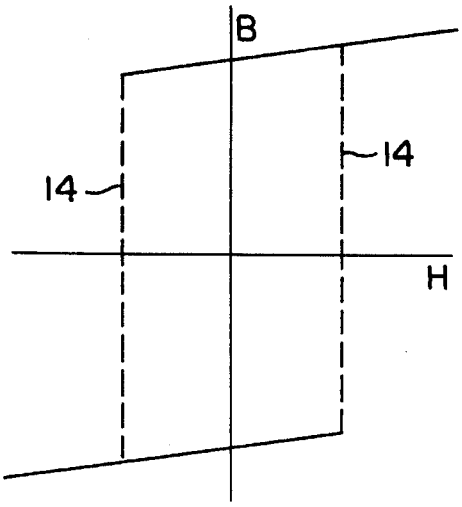
FIG. 2 (PRIOR ART)
FIG. 2 is a hysteresis curve illustrative of the magnetic characteristics of the marker of FIG. 1.
Figure 3:
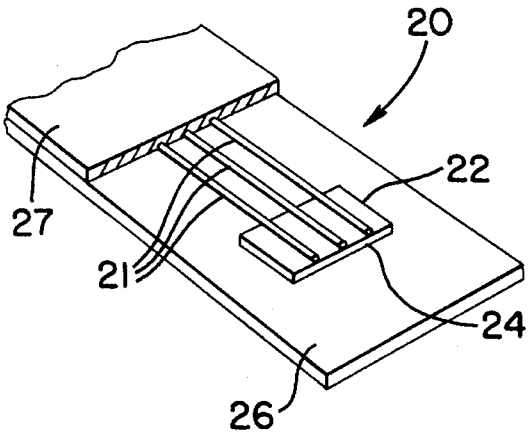
FIG. 3 is a view similar to FIG. 1 but showing a marker in accordance with the present invention.
Figure 4A:
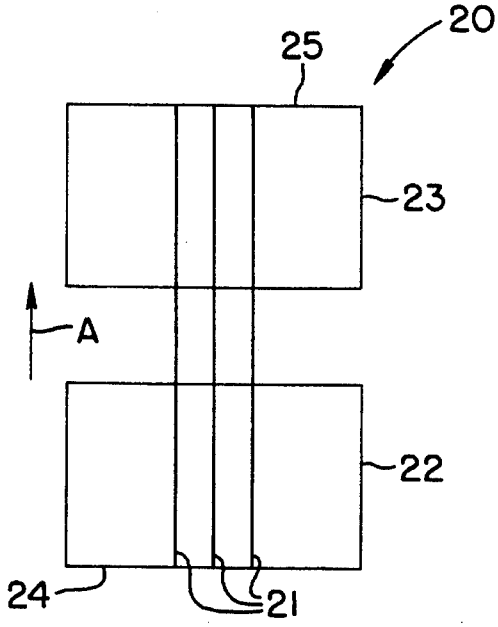
FIG. 4A is a schematic plan view of the marker of FIG. 3, and FIGS. 4B and 4C are respectively schematic plan views of alternative arrangements of the marker according to the invention.

Referring to FIG. 3, a marker in accordance with the present invention is generally indicated by reference numeral 20. The marker 20 includes three re-entrant wires 21 arranged in parallel and a magnetic charge spreading member 22 connecting the ends of the wires 21 so as to magnetically couple the wires 21 and to reduce the demagnetizing effect at the ends of the re-entrant wires. Although not shown in FIG. 3, the opposite ends of the wires 21 are also magnetically coupled by a second magnetic charge spreader 23. As shown in FIGS. 3 and 4A, the respective ends of wires 21 at one end of the marker 20 are substantially flush with an outer edge 24 of magnetic charge spreader 22 while the opposite ends of wires 21 are substantially flush with an outer edge 25 of magnetic charger spreader 23. The active elements of the marker 20, namely wires 21 and magnetic charge spreaders 22 and 23, are sandwiched between a substrate 26 and an overlayer 27, which are similar to conventional substrate 12 and overlayer 13 of the prior art marker 10 illustrated in FIG. 1.

In a preferred embodiment of the invention, the wires 21 have a diameter of about 0.050 mm and a length in the range of 20 to 30 mm. For example, the wires may be about 25 mm long. The wires are preferably formed from an amorphous, water-quenched composition of $Fe_{77.5}Si_{7.5}B_{15}$ that is die-drawn from a diameter as-cast of about 0.127 mm down to a diameter of about 0.050 mm. The degree of residual stress resulting from the die-drawing is such that the wires exhibit hard magnetic properties, and it is therefore necessary to anneal the wire after drawing to relieve some but not all of the stress in order to recover the desired soft magnetic characteristic, including large Barkhausen discontinuities. Preferably the annealing of the die-drawn wire is performed at a temperature of 400° C. for a period of 30 minutes while applying tension to the wire. The tension is applied, for example, by suspending a weight (preferably 1.18 kg) from one end of the wire. As a result, some of the stress caused by the die-drawing is removed from the wire by annealing, but a controlled amount of stress remains.

As an alternative, the desired properties of the wire can be achieved by a two-step process in which the wire is initially annealed without stress to recover the wire's soft magnetic properties, and then, after annealing, stress is induced in the wire to obtain the desired re-entrant response.

It is also contemplated by the invention to use thin wires that are not die-drawn. Moreover, the wires 21 may be formed of a crystalline re-entrant material rather than an amorphous material.

The magnetic charge spreaders 22 and 23 are preferably cut from a thin ribbon of a high permeability (in the range 5,000–10,000) amorphous material such as Metglas. Before cutting, the amorphous ribbon is annealed in the presence of a magnetic field in order to control the direction of magnetic anisotropy. Heating for about 30 minutes at a temperature of 300° to 350° with a saturating DC field (10 to 20 Os) has been found to be satisfactory. The field-annealed ribbon is then cut to squares of about 2 mm×2 mm to form the magnetic charge spreader elements. The wires 21 are laid on the magnetic charge spreaders 22 and 23 according to the configuration shown in FIG. 4A and with the direction of anisotropy of both magnetic charge spreaders being oriented as indicated by the arrow A, i.e. in the same direction as the length of the wires 21. The wires 21 may be attached to the magnetic charge spreaders 22 and 23 by adhesive on the magnetic charge spreaders, or by adhesive tape applied on top of the wires and magnetic charge spreaders, for example.

It will be understood that FIG. 4A and also FIGS. 4B and 4C to be discussed hereinafter, are highly schematic, and are not drawn to consistent scale either in the horizontal or vertical direction. It will also be recognized that FIGS. 4A–4C have generally been compressed in the vertical direction. It should also be noted that, for clarity of representation in FIG. 3, the thickness and relative spacing of the wires 21, and the size of the magnetic charge spreader 22, have been exaggerated.

Although all three of the wires 21 are shown in the drawings as being straight and in parallel with each other and without displacement in the longitudinal direction, it is believed that a modest degree of bending in the wires, divergence from parallel and/or longitudinal displacement among the wires will not have a significant adverse effect upon the performance of the marker. However, the corresponding ends of the wires should be joined within a rather small distance on the magnetic charge spreader since it is believed that all three wires should be coupled through a single magnetic domain of the magnetic charge spreader in order to obtain the desired simultaneous switching of magnetic polarity.

It is also believed that a moderate variation in length, diameter, and/or composition among the wires will not prevent satisfactory operation, although it is preferred that all three wires be of the same length, diameter and composition.

Alternatives to the preferred composition of the wire as mentioned above include materials currently used for re-entrant wires in commercially available harmonic EAS systems. The magnetic charge spreaders may be formed of high permeability materials other than Metglas, but should have the predetermined direction of magnetic anisotropy shown in FIG. 4A. A preferred composition for the magnetic charge spreaders is $(Co_{0.94}Fe_{0.06})_{79}Si_{2.1}B_{18.9}$.

Figure 4B:
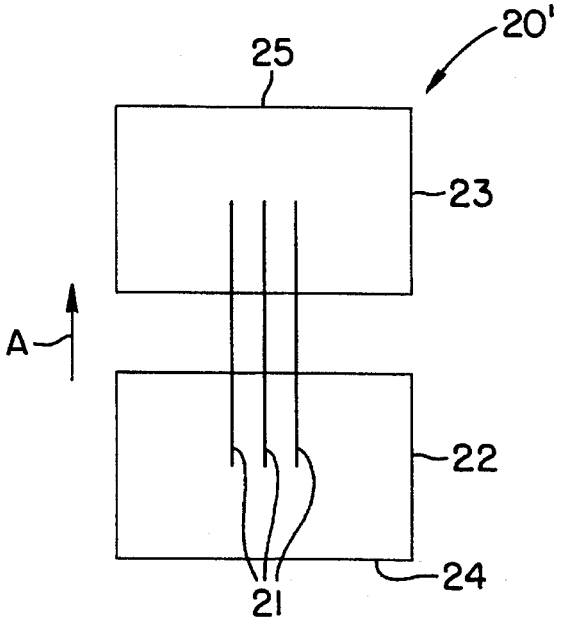
Figure 4C:
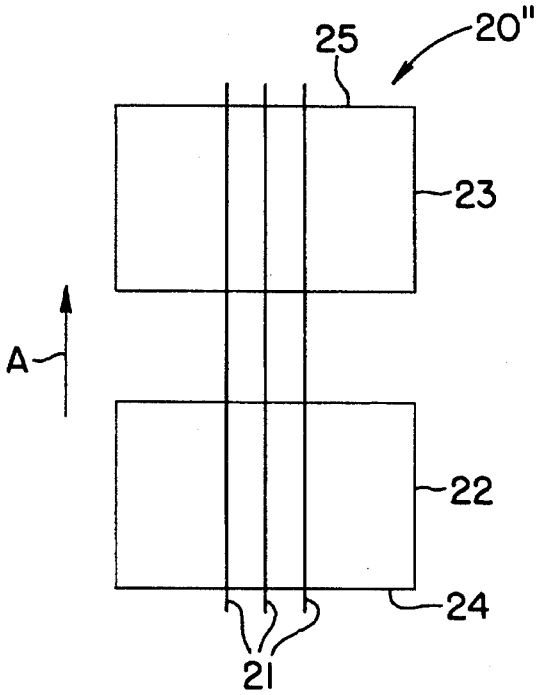

Alternative configurations of the wires 21 and the magnetic charge spreaders 22 and 23 are shown in FIGS. 4B and 4C. It will be noted in FIG. 4B that the ends of the wires 21 are arranged at central portions of the magnetic charge spreaders rather than at outer edges thereof. On the other hand, in FIG. 4C, the ends of the wires 21 extend a short distance outboard from the outer edges 24 and 25 of the magnetic charge spreaders.

It is within the contemplation of the invention to use two wires, or four or more wires, rather than three as shown in FIGS. 4A–4C. A limiting factor on the number of wires is the above-noted desirability of coupling all the wires by a single domain on the magnetic charge spreading element.

After the marker 20, Including the wires 21, the magnetic charge spreaders 22 and 23, the substrate 26 and the overlayer 27, has been assembled, the marker may be attached to an article of merchandise by an adhesive layer (not shown) provided on the underside of the substrate 26, or by other conventional techniques.

If it is desired that the marker 20 be deactivatable, then a control element (not shown) of a conventional type, such as a semi-hard magnet formed of Arnokrome 3 or Crovac, may be included in the marker 20. Deactivation of the marker 20 can then be performed by magnetizing the control element to provide a bias field which changes the response of the wires 21 to the surveillance field. It is also contemplated to deactivate the markers 20 by relieving stress in the wires 21 or crystallizing the wires 21 in the case where the wires 21 are of an amorphous material.

Figure 5:
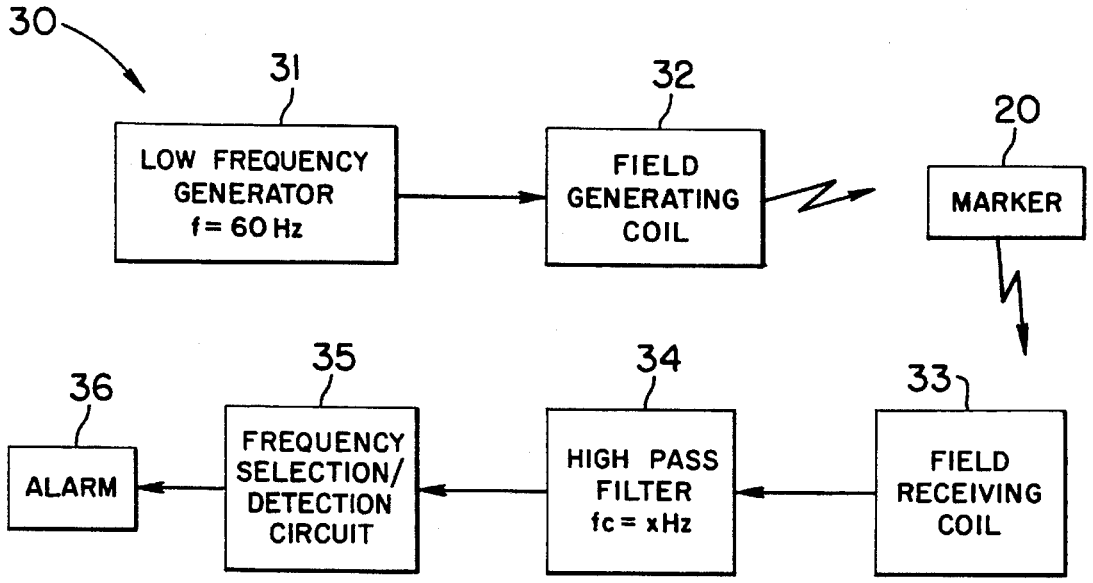
FIG. 5 is a block diagram of a typical system for generating a surveillance field and detecting the markers of the present invention.

A harmonic EAS system with which the marker 20 may be used is illustrated in block diagram form in FIG. 5. This system, generally indicated by reference numeral 30, includes a low-frequency generator 31 which generates a signal with a frequency around 60 Hz to drive a field generating coil 32. When a marker 20 is present in the field generated by the coil 32, perturbations caused by the marker 20 are received at a field receiving coil 33. A signal output from the field receiving coil 33 passes through a high pass filter 34 which has a suitable cut-off frequency. The signal which passes through the filter 34 is supplied to a frequency selection/detection circuit 64, which can be set to detect a signal having a predetermined pattern of frequency, amplitude and/or pulse duration. Upon detection of the predetermined signal pattern, the circuit 35 furnishes an output signal to activate an alarm 36. Except for the marker 20, all of the elements shown in FIG. 5 may be like those presently used in the aforementioned "AISLEKEEPER" harmonic EAS system.

To summarize, a shorter harmonic EAS marker than has previously been practical is realized by arranging two or more re-entrant wires in parallel in the harmonic marker, and coupling the wires by magnetic charge spreading elements so that all of the wires undergo substantially simultaneous polarity switching in response to a surveillance field. As a result, the signal provided by the marker is of comparable amplitude to signals provided by conventional markers of much greater length. A practical marker having a length of about 25 mm can be constructed in this way and can be used for applications in which a short marker is desirable, including integration with a price-marking label.

Having described the present invention with reference to the presently preferred embodiments thereof, it should be understood that various changes can be made without departing from the true spirit of the invention as defined in the appended claims.

What is claimed is:

1. A marker for use in an article surveillance system in which an alternating magnetic field is established in a surveillance region and an alarm is activated when a predetermined perturbation to said field is detected, said marker comprising:

a plurality of bodies of magnetic material each having a magnetic hysteresis loop with a large Barkhausen discontinuity such that exposure of said body to an external magnetic field, whose field strength in the direction opposing the magnetic polarization of said each body exceeds a predetermined threshold value, results in regenerative reversal of said magnetic polarization;

coupling means for magnetically coupling said plurality of bodies so that said bodies exhibit substantially simultaneous regenerative reversal of their respective magnetic polarizations upon exposure of said marker to said external magnetic field having a field strength exceeding said predetermined threshold value in the direction opposing the magnetic polarization of said bodies; and means for securing said bodies and said coupling means to an article to be maintained under surveillance.

2. A marker according to claim 1, wherein said coupling means includes means for spreading magnetic charge at ends of said bodies of magnetic material.

3. A marker according to claim 2, wherein each of said bodies is a length of metal material, said bodies are arranged substantially in parallel with each other, and said coupling means includes first and second coupling members for respectively coupling said bodies at first and second positions along said bodies.

4. A marker according to claim 3, wherein each of said bodies is a length of amorphous metal wire having a first end and a second end.

5. A marker according to claim 4, wherein said first coupling member magnetically couples said bodies at said first ends thereof and said second coupling member magnetically couples said bodies at said second ends thereof.

6. A marker according to claim 4, wherein said plurality of bodies consists of three lengths of amorphous metal wire.

7. A marker according to claim 4, wherein said amorphous metal wire is formed by die-drawing.

8. A marker according to claim 4, wherein said bodies are substantially identical in size, shape and composition.

9. A marker according to claim 4, wherein said bodies each have a length within the range of about 20–30 mm and a diameter of about 0.050 mm.

10. A marker according to claim 3, wherein each said coupling member is formed of an amorphous metal having high permeability.

11. A marker according to claim 3, wherein each of said coupling members has a direction of magnetic anisotropy oriented in the same direction as said bodies.

12. A marker according to claim 3, wherein each of the bodies has the composition $Fe_{77.5}Si_{7.5}B_{15}$.

13. A marker according to claim 3, wherein each of the bodies is formed of a crystalline metal.

14. An article surveillance system comprising:

(a) generating means for generating an alternating magnetic field in a surveillance region;

(b) a marker secured to an article appointed for passage through said surveillance region, said marker including a plurality of bodies of magnetic material each having a magnetic hysteresis loop with a large Barkhausen discontinuity such that exposure of said body to an external magnetic field, whose field strength in the direction opposing the magnetic polarization of said each body exceeds a predetermined threshold value, results in regenerative reversal of said magnetic polarization, and a coupling means for magnetically coupling said plurality of bodies so that said bodies exhibit substantially simultaneous regenerative reversal of their respective magnetic polarizations upon exposure of said marker to said external magnetic field having a field strength exceeding said predetermined threshold value in the direction opposing the magnetic polarization of said bodies; and (c) detecting means for detecting a perturbation to said alternating magnetic field in said surveillance region resulting from the presence of said marker in said surveillance region.

15. An article surveillance system according to claim 14, wherein each of said bodies is a length of metal material, said bodies are arranged substantially in parallel with each other, and said coupling means includes first and second coupling members for respectively coupling said bodies at first and second positions along said bodies.

16. An article surveillance system according to claim 15, wherein each of said bodies is a length of amorphous metal wire having a first end and a second end, said first coupling member magnetically couples said bodies at said first ends thereof, and said second coupling member magnetically couples said bodies at said second ends thereof.

17. An article surveillance system according to claim 16, wherein said plurality of bodies consists of three lengths of amorphous metal wire.

18. An article surveillance system according to claim 15, wherein each of said bodies is a length of crystalline metal wire.

19. An article surveillance system according to claim 15, wherein each of said coupling members has a direction of magnetic anisotropy oriented in the same direction as said bodies.

20. An article surveillance system according to claim 14, wherein said marker has a length not exceeding about 30 mm.

21. A method of making a marker for use in an article surveillance system in which an alternating magnetic field is established in a surveillance region and an alarm is activated when a predetermined perturbation to said field is detected, the method comprising the steps of:

providing a plurality of bodies of magnetic material each having a magnetic hysteresis loop with a large Barkhausen discontinuity such that exposure of said body to an external magnetic field, whose field strength in the direction opposing the magnetic polarization of said each body exceeds a predetermined threshold value, results in a regenerative reversal of said magnetic polarization;

providing at least one magnetic charge spreading member; and mounting said plurality of bodies on said at least one magnetic charge spreading member so that said at least one member magnetically couples said plurality of bodies.

22. A method according to claim 21, wherein each of said bodies is a length of metal material and said mounting step includes mounting said plurality of bodies on said at least one magnetic charge spreading member so that said plurality of bodies are arranged substantially in parallel with each other.

23. A method according to claim 22, wherein said at least one member includes a first magnetic charge spreading member and a second magnetic charge spreading member and said mounting step includes mounting said plurality of bodies on said first and second members so that said first and second members are located respectively at first and second positions along said bodies.

24. A method according to claim 23, wherein each of said bodies is a length of amorphous metal wire having a first end and a second end, and said mounting step includes mounting said bodies on said first and second members so that said first member is located at the respective first ends of said bodies and said second member is located at the respective second ends of said bodies.

25. A method according to claim 24, wherein said plurality of bodies consists of three lengths of amorphous wire.

26. A method according to claim 23, wherein each of said bodies is a length of crystalline metal wire.

27. A method according to claim 21, wherein said step of providing said plurality of bodies includes die-drawing an amorphous metal wire, said die-drawn wire having residual stress therein, and then annealing said die-drawn wire to relieve at least some of said residual stress.

28. A method according to claim 27, wherein said die-drawn wire is annealed at 400° C. for a period of 30 minutes.

29. A method according to claim 28, wherein tension is applied to said die-drawn wire during said annealing so that a controlled amount of stress remains in said wire after said annealing.

30. A method according to claim 21, wherein said step of providing said at least one magnetic charge spreading member includes annealing an amorphous metal ribbon in the presence of a saturating DC magnetic field to control a direction of magnetic anisotropy of said ribbon and cutting said annealed ribbon to form said at least one magnetic charge spreading member.

31. A method according to claim 30, wherein each of said plurality of bodies is a length of metal material and said mounting step includes mounting said plurality of bodies substantially in parallel with each other on said at least one magnetic charge spreading member and oriented in a direction that is the same as a direction of magnetic anisotropy of said at least one magnetic charge spreading member.

32. A method according to claim 21, wherein said at least one magnetic charge spreading member is formed by cutting a ribbon of Metglas.

33. A method according to claim 21, wherein said plurality of bodies have the composition $Fe_{77.5}Si_{7.5}B_{15}$.

34. A method according to claim 21, wherein each of said plurality of bodies has a length not exceeding about 30 mm.

* * * * *

UNITED STATES PATENT AND TRADEMARK OFFICE

CERTIFICATE OF CORRECTION

PATENT NO. : 5,519,379

DATED : May 21, 1996

INVENTOR(S) : Wing Ho and Jiro Yamasaki

It is certified that error appears in the above-indentified patent and that said Letters Patent is hereby corrected as shown below:

On the cover page, Item [22], change "19" to -- 10 --.

Col. 4, line 5, change "$O_s$" to -- $O_e$ --.

Signed and Sealed this

Fourteenth Day of January, 1997

Bruce Lehman

*Attest:*

BRUCE LEHMAN

*Attesting Officer*

*Commissioner of Patents and Trademarks*